US007703428B2

(12) United States Patent
Nakayama et al.

(10) Patent No.: US 7,703,428 B2
(45) Date of Patent: Apr. 27, 2010

(54) SPARK PLUG AND INTERNAL COMBUSTION ENGINE IN WHICH THE SPARK PLUG IS DISPOSED

(75) Inventors: Katsutoshi Nakayama, Nagoya (JP); Hiroyuki Kameda, Aichi-gun (JP)

(73) Assignee: NGK Spark Plug Co., Ltd, Nagoya-shi, Aichi (JP)

( * ) Notice: Subject to any disclaimer, the term of this patent is extended or adjusted under 35 U.S.C. 154(b) by 64 days.

(21) Appl. No.: 12/207,616

(22) Filed: Sep. 10, 2008

(65) Prior Publication Data

US 2009/0071429 A1 Mar. 19, 2009

(30) Foreign Application Priority Data

Sep. 13, 2007 (JP) ..... 2007-237563
Aug. 6, 2008 (JP) ..... 2008-202734

(51) Int. Cl.
*H01T 13/02* (2006.01)
*H01T 13/00* (2006.01)
*H01T 13/20* (2006.01)

(52) U.S. Cl. ..... 123/169 R; 313/136

(58) Field of Classification Search ..... 123/169 R, 123/169 E, 169 EL; 313/136, 141, 142, 143, 313/137

See application file for complete search history.

(56) References Cited

U.S. PATENT DOCUMENTS 4,406,968 A * 9/1983 Friese et al. ..... 313/136
6,265,816 B1 * 7/2001 Ito et al. ..... 313/141
6,819,030 B2 11/2004 Lipp et al.

FOREIGN PATENT DOCUMENTS

JP 59-151792 A 8/1984
JP 60-235379 A 11/1985
JP 63-216282 A 9/1988
JP 2003-308945 A 10/2003
JP 2006-012464 A 1/2006

OTHER PUBLICATIONS

Notice of Allowance mailed Sep. 4, 2009 for corresponding Japanese Patent Application No. 2008 202734.

* cited by examiner

*Primary Examiner*—Hieu T Vo
(74) *Attorney, Agent, or Firm*—Darby & Darby PC; Matthew M. Gaffney

(57) ABSTRACT

To provide a spark plug with improved heat resistance and an internal combustion engine in which that spark plug is mounted where there is good conduction of the heat near the opening on the combustion chamber side of the mounting hole for the spark plug provided in the engine and the effects of thermal stress occurring near that opening are mitigated. A cylindrical part without threads formed thereon is provided on the leading end side of a metal housing of a spark plug and the thermal stress applied to a mounting hole is mitigated by avoiding close contact with the mounting hole of an engine head. Furthermore, the spark plug has a mounting structure in which the leading end surface of the cylindrical part is disposed 1.55 mm or more to the base end side in a mounting hole in the direction of the axial line O with respect to the wall surface inside the combustion chamber. By this means, the metal housing does not easily take up the heat that accompanies combustion of the air-fuel mixture inside the combustion chamber at the cylindrical, part so there may be good heat conduction.

7 Claims, 6 Drawing Sheets

SPARK PLUG AND INTERNAL COMBUSTION ENGINE IN WHICH THE SPARK PLUG IS DISPOSED

CROSS-REFERENCE TO RELATED APPLICATION

The present application claims priority under 35 U.S.C. §119 to Japanese Patent Application Nos. 2007-237563 filed Sep. 13, 2007 and 2008-202734 filed Aug. 6, 2008. The content of the applications are incorporated herein by reference in their entireties

TECHNICAL FIELD

The present invention relates to a spark plug mounted in an internal combustion engine that ignites a air-fuel mixture and an internal combustion engine in which the spark plug is mounted.

BACKGROUND OF THE INVENTION

Conventionally, spark plugs are used for ignition in internal combustion engines such as automobile engines. A typical spark plug has a central electrode that forms an electrode for spark discharge on its leading end side, an insulator that holds that central electrode in an axial hole and a metal housing that surrounds and holds the radial periphery of this insulator. Furthermore, the spark plug is mounted in the engine by screwing the threads formed on the outer peripheral surface of the metal housing into the female threads provided in a mounting hole in the engine head, and an air-fuel mixture is ignited by the spark discharge.

In recent years there has been progress in increasing the output and reducing the fuel consumption of internal combustion engines, and while the engines are getting smaller, there have been increases in the diameter of exhaust valves to improve exhaust efficiency and denser formation of the water jacket to improve cooling efficiency. The diameter of the mounting holes for spark plugs has been reduced to be able to assure freedom of design on the engine side, and for the spark plugs mounted in these mounting holes, small ones where the nominal diameter for the threads is 12 mm or less are used.

Furthermore, the thickness of the engine head has been reduced because of the reduction in size, and the same heat load has a larger effect at the periphery of the mounting hole where the spark plug is affixed than it did conventionally. This is because there has been a relative reduction in the heat capacity because of the reduction in the thickness of the engine head. Since the temperature on the combustion chamber side of the mounting hole is particularly high in the vicinity of the opening, the thermal stress caused by the combustion of the air-fuel mixture is large. In addition, the effects of the mechanical load that the spark plug applies to the mounting hole because of the screwing in of the threads are especially great, and there is a danger of damage in the vicinity of the opening on the combustion chamber side of the mounting hole. The engine head has become more susceptible to thermal stress overall in the area around the mounting hole that secures the spark plug. To solve this problem, it is good to eliminate or reduce the part where the spark plug is in close contact in the vicinity of the opening on the combustion chamber side of the mounting hole. Here, for example, with the reduction in the inside diameter of the mounting hole in the engine head for the purpose of increasing the freedom of engine design, there are spark plugs where no threads are formed on the outer peripheral surface on the leading end side and threads that are difficult to reduce in diameter are formed on the base end side of the outer peripheral surface of the metal housing (for example, Published Unexamined Patent Application No. JP 2003-308945. If this spark plug is used, the part where the mounting hole and spark plug are in close contact can be eliminated in the vicinity of the opening on the combustion chamber side of the mounting hole, and the effects of the thermal stress that may arise at the mounting hole can be mitigated.

By the way, the heat accompanying combustion of the air-fuel mixture in the combustion chamber that is taken up by the grounding electrode and metal housing mainly escapes via the threads. If no threads are formed on the outer peripheral surface on the leading end side of the metal housing, there is a reduction in the contact surface area of the metal housing and mounting hole. Therefore, there is a danger that sufficient heat conduction from the metal housing to the engine head will not occur, and the heat resistance of the spark plug will be reduced.

It is an object of the present invention to solve the problems described above and provide a spark plug with improved heat resistance and an internal combustion engine in which that spark plug is mounted where good heat conduction in the vicinity of the opening on the combustion chamber side of the mounting hole for the spark plug provided in the engine head occurs while mitigating the effects of thermal stress that may arise in the vicinity of that opening.

SUMMARY OF THE INVENTION

The spark plug according to the present invention has a central electrode, an insulator having an axial hole extending in the direction of an axial line and holding the central electrode at a leading end side of the axial hole, a metal housing including: a cylindrical hole extending in the direction of the axial line and holding at least a part of the insulator in the cylindrical hole; a mounting part having screw threads to be screwed into a mounting hole of an internal combustion engine on an outer peripheral surface of the mounting part, the screw threads having a nominal diameter of 12 mm or less; a cylindrical part provided on a leading end side of the mounting part, the cylindrical part having a diameter smaller than a diameter of the mounting part and having a leading end surface which is to be disposed inside the mounting hole; a first tapered part connecting an outer peripheral surface between the cylindrical part and the mounting part in the vicinity of the leading end of the mounting part in a tapered shape; a flange part provided on the base end side of the mounting part, the flange part having a diameter larger than a diameter of the mounting part; and a second tapered part connecting an outer peripheral surface between the mounting part and the flange part in a tapered shape, where B/A is 0.2 or greater; B is 2 mm or greater, and C−B is 1.5 mm or greater when A is an axial length from an leading end of the second tapered part to the leading end surface of the cylindrical part, B is an axial length from the leading end of the first tapered part to the leading end surface of the cylindrical part, and C is the maximum axial length form the leading end of the first tapered part to an opening end on the combustion chamber side of the mounting hole when the metal housing is screwed into the mounting hole of the internal combustion engine.

According to the present invention, the metal housing has a mounting part on which threads are formed, and there is a cylindrical part where no threads are formed on the leading end side in the direction of the axial line from that mounting part. Furthermore, it is provided that B/A is 0.2 or greater and B is 2 mm or greater for the size cylindrical part. Therefore, it is assured that the metal housing will not be in close contact with the parts near the combustion chamber inside the mounting hole where the spark plug is mounted. In other words, the effects of thermal stress arising in the mounting hole when the mounting hole is in close contact with the metal housing at the part on the combustion chamber side of the mounting hole are mitigated by providing the cylindrical part on the metal housing. Since a thermal load is applied to the parts of the mounting hole on the combustion chamber side with combustion of the air-fuel mixture in the combustion chamber, the life of the engine head provided with the mounting hole can be increased if the effects of the thermal stress arising in the mounting hole because of close contact with the metal housing can be mitigated.

Moreover, while threads are formed on the metal housing in the present invention, the constitution is such that threads are not formed on the cylindrical part on the leading end side of those threads. When this spark plug is screwed into the mounting hole of an internal combustion engine (engine head), the spark plug cannot be installed in the internal combustion engine using a suitable torque (tightening torque) because of the frictional resistance that arises between the cylindrical part and the mounting hole when the spark plug is rotated while being screwed in. In other words, the "the cylindrical part having a diameter smaller than a diameter of the mounting part" means that the constitution is such that the cylindrical part does not come into close contact with the mounting hole even though the mounting part is in contact with the mounting hole when the spark plug is screwed into the mounting hole.

Furthermore, when the spark plug is mounted in the mounting hole according to the present invention, the mounting structure is such that the leading end surface of the cylindrical part is disposed in the mounting hole, and C−B is 1.5 mm or more. Therefore, a constitution in which it is difficult for the thermal load that accompanies combustion of the air-fuel mixture in the combustion chamber to be applied to the cylindrical part of the spark plug is achieved. In other words, there can be a reduction in the amount of heat received by the metal housing through the cylindrical part over the case when C−B is less than 1.5 mm or when the leading end surface of the cylindrical part protrudes into the combustion chamber from the inside wall surface of the combustion chamber. This does not mean that this effect cannot be obtained unless all of the periphery of the leading end surface of the cylindrical part is disposed in the mounting hole back from the opening on the combustion chamber side of the mounting hole. Namely, it is sufficient to have a constitution in which part of the leading end surface of the cylindrical part is disposed in the mounting hole back from the opening on the combustion chamber side of the mounting hole. In addition, the cylindrical part plays the role of transferring the heat received by the grounding electrode to the first tapered part and mounting part. Furthermore, the heat is conducted toward the engine head side from the metal housing through the first tapered part and mounting part.

Therefore, since the amount of heat transmitted to the first tapered part and mounting part from the cylindrical part is reduced by reducing the amount of heat reduction in the cylindrical part, the heat flows smoothly in the cylindrical part, and the structure is such that it is difficult for the heat to be confined. Therefore, since the heat can be conducted smoothly to the cylindrical part from the grounding electrode, the increase in the spark plug temperature can be controlled and the heat resistance increased. Moreover, there is no requirement for the first tapered part to be formed continuously in a ring shape around the entire circumference in the circumferential direction of the mounting part, and for example, the thread on the leading end side in direction of the axial line can be made into the first tapered part.

In addition, the spark plug according to the present invention is provided with a grounding electrode where one end is connected to the leading end surface of the cylindrical part of the metal housing and the other end forms a spark discharge gap with the leading end of the central electrode, and the constitution is such that D is 3 mm or greater where D is the minimum length from the opening on the combustion chamber side of the mounting hole to the leading end side part of the grounding electrode when the metal housing is screwed into the mounting hole of the internal combustion engine.

If the spark plug has a mounting structure capable of smoother heat conduction for the metal housing as described above, the heat can be conducted from the grounding electrode smoothly when that grounding electrode is connected to the leading end surface of the cylindrical part. It is true, however, since the leading end surface of the cylindrical part is disposed within the mounting hole, the amount (size) that the grounding electrode protrudes into the combustion chamber is reduced. Therefore, if the constitution is such that D is 3 mm or more as in the present invention, the spark discharge gap formed between the grounding electrode and central electrode can be disposed so as to protrude into the combustion chamber, and ignition performance can be assured.

In addition, there can be a constitution where E is 9 mm or less where E is the length from the leading end surface of the cylindrical part of the metal housing to the part at leading end side of the grounding electrode in the direction of the axial line in the spark plug according to the present invention.

Alternatively, a grounding electrode in which one end is connected to the leading end surface of the cylindrical part of the metal housing and the other end forms a spark discharge gap with the leading end of the central electrode and the constitution is such that E is 9 mm or less where E is the length from the leading end surface of the cylindrical part of the metal housing and the part location at the leading end side of the parts of the grounding electrode in the direction of the axial line can be provided.

It is preferable to make E large to position the grounding electrode such that it protrudes sufficiently into the combustion chamber when the leading end surface of the cylindrical part is disposed in a location that is further back in the mounting hole as described above. On the other hand, the grounding electrode becomes longer, and the path for the heat to escape to the cylindrical part side of the grounding electrode itself becomes longer, so there is a danger of an increase in the temperature of the grounding electrode. Therefore, E can be set at 9 mm or less as in the present invention. Even if the temperature of the grounding electrode rises when E is 9 mm or less in a state where B/A is 0.2 or greater, that temperature will not exceed the temperature limits for heat resistance in the grounding electrode (temperature limit for oxidation of the grounding electrode material).

In addition, in the spark plug according to the present invention, F>G when F is the minimum distance for the outer peripheral edge of the insulator leading end surface and the inner peripheral edge of the metal housing leading end surface, and G is the minimum distance for the outer peripheral edge of the insulator leading end surface and the combustion chamber side opening of the mounting hole.

When carbon fouling arises in a spark plug, spark discharge does not occur regularly at the spark discharge gap (for example, between the central electrode and the grounding electrode), and current flows in carbon that adheres to the leading end surface of the insulator. There are cases where spark discharge occurs between the outer peripheral edge of the insulator leading end surface that is covered with this carbon and the leading end surface of the metal housing (cylindrical part). If the leading end surface of the cylindrical part in the direction of the axial line is disposed inside the mounting hole back from the opening end of the mounting hole as described above, the spark discharge described above that occurs during carbon fouling is generated at a location further back inside the mounting hole from the opening end of the mounting hole.

Therefore, when F>G is satisfied as in the present invention, the outer peripheral edge of the insulator leading end surface is closer to the opening end of the mounting hole with respect to the inner peripheral edge of the leading end surface of the cylindrical part along a straight line. Therefore, it is easy for spark discharge to occur between the outer peripheral edge of the insulator leading end surface and to the opening end of the mounting hole during carbon fouling. In other words, since the spark discharge can be made to occur at a location closer to the combustion chamber, it is easy for the air-fuel mixture to ignite and ignition performance can be assured.

Moreover, if the leading end surface of the metal housing and the opening of the mounting hole are in close proximity according to the present invention, there are cases where assurance of ignition performance is limited. To be more certain in assuring ignition performance, it is preferable for the difference between C and B to be 1.5 mm or more (C−B>1.5 mm).

In addition, the spark plug according to the present invention can be provided with an internally protruding part that protrudes from the inside peripheral surface of the cylindrical hole of the metal housing toward the inside, extending across the entire periphery, the insulator engaged with a base end side of the internally protruding part in the direction of the axial line, the leading end of the internally protruding part being positioned on the base end side with respect to the first tapered part of the leading end.

When the central electrode receives the heat accompanying the combustion of the air-fuel mixture in the combustion chamber, it is transferred to the metal housing through the insulator that holds the central electrode. The heat is conducted to the engine head through the first tapered part of the metal housing and the mounting part. At that time, the heat from the insulator to the metal housing is conducted through the internally protruding part provided inside the cylindrical hole that holds the insulator in the cylindrical hole of the metal housing. At this time, the heat taken up by the cylindrical part of the metal housing is conducted to the engine head through the first tapered part and mounting part, but if there is a confluence of that heat with the heat conducted from the insulator, the amount of heat accumulated (the amount of heat present in the metal housing) becomes high in comparison, and there is a danger that it will become difficult for it to be conducted to the engine head quickly. According to the present invention, the leading end of the internally protruding part can be more to the base end side in the direction of the axial line with respect to the first tapered part of the metal housing. Thus, the heat taken up by the cylindrical part first reaches the first tapered part before the internally protruding part, so it is easier for further heat to be conducted to the engine head side through the first tapered part. Therefore, even if there is a confluence of the heat conducted from the insulator and the heat taken up by the cylindrical part, the heat from the cylindrical part is reduced quickly, so the heat can be conducted rapidly to the engine head.

In addition, the internal combustion engine according to the present invention has a mounting hole that opens into the combustion chamber and has female threads formed on the inside periphery. The spark plug according to the present invention is mounted in this mounting hole.

Since the spark plug according to the invention described above is mounted in the mounting hole of the engine head in the internal combustion engine according to the present invention, the effects of the thermal stress that can occur in the vicinity of the opening on the combustion chamber side of the mounting hole are mitigated and heat conduction from the spark plug is good.

DETAILED DESCRIPTION OF THE INVENTION

Figure 1:
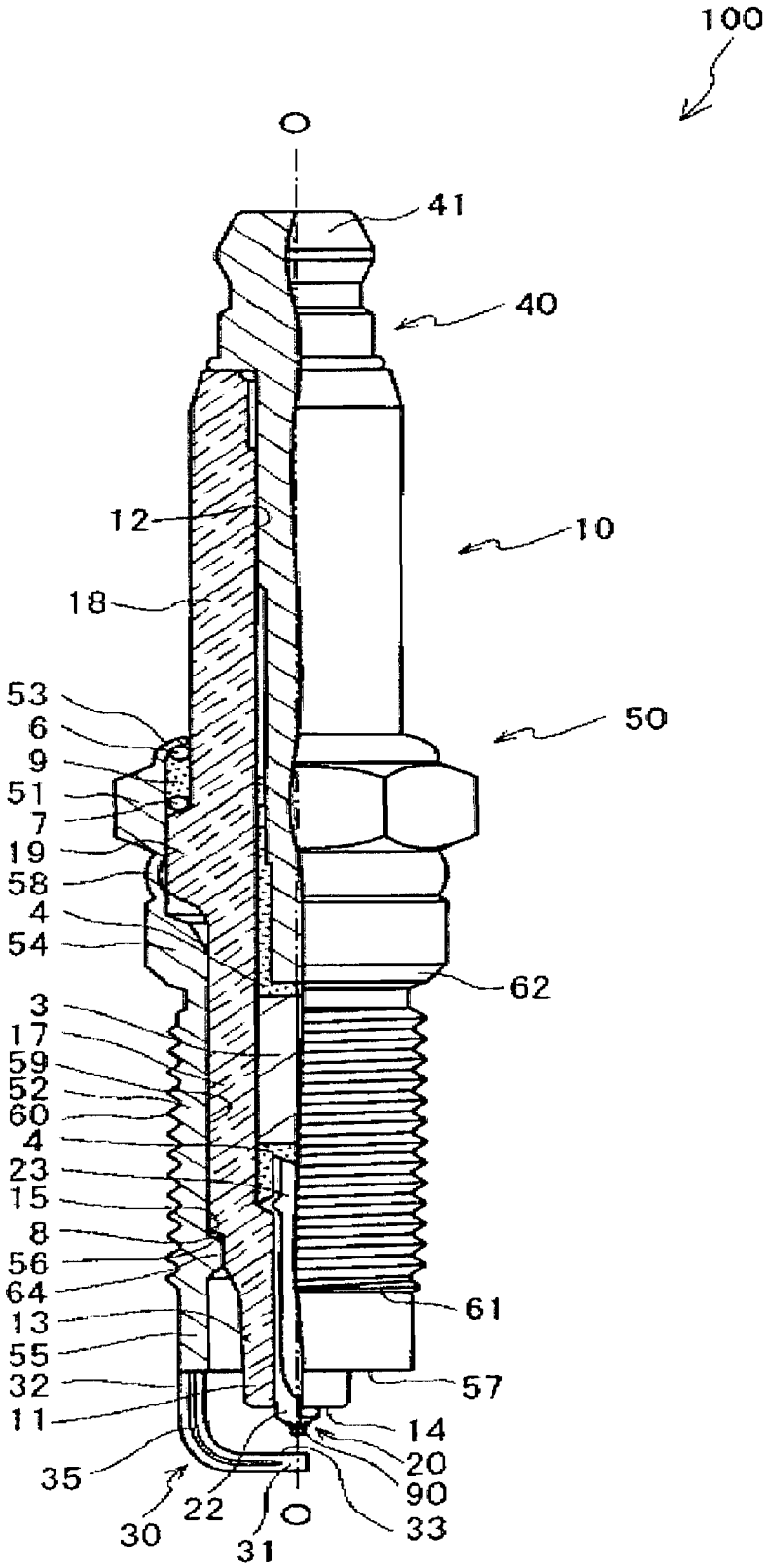
FIG. 1 is a partial cross-sectional view of a spark plug of the present invention.
Figure 2:
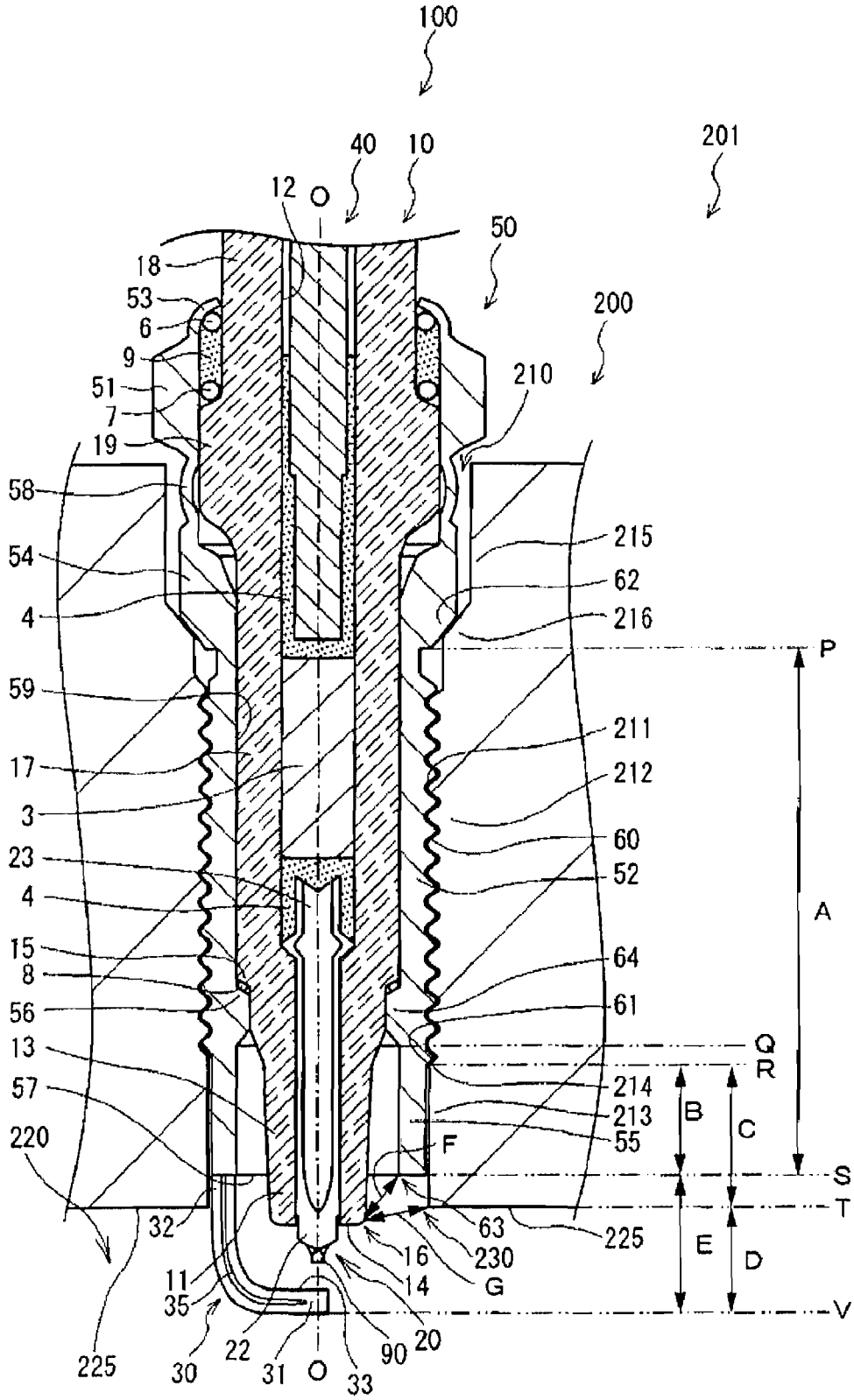
FIG. 2 is a cross-sectional view showing the state of the spark plug assembled into an engine head of an internal combustion engine.

An embodiment of the spark plug according to the present invention will be described with reference to the drawings. First of all, the structure of a spark plug 100 and an internal combustion engine 201 in which that spark plug 100 is mounted will be described with reference to FIG. 1 and FIG. 2. FIG. 1 is a partial cross-sectional view of the spark plug 100. FIG. 2 is a cross-sectional view of showing a state where the spark plug 100 is mounted in an engine head 200 of the internal combustion engine 201. Moreover, the direction of the axial line O of the spark plug 100 is vertical in FIG. 1 and FIG. 2. The description will be given with the leading end side (front) of the spark plug 100 downward and the base end side (back) on top.

As is shown in FIG. 1, the spark plug 100, in brief, comprises an insulator 10, a metal housing 50 that holds this insulator 10, a central electrode 20 held inside the insulator 10 in the direction of the axial line O, a grounding electrode 30 that is welded on one end (base end part 32) to the leading end surface 57 of the metal housing 50 (the leading end surface 57 of a cylindrical part 55 that will be described later) with the other end (leading end part 31) bent so that the inner surface 33 of the leading end part 31 faces a noble metal tip 90 provided on the leading end of the central electrode 20, and a metal terminal 40 provided on the back end of the insulator 10.

First, the insulator 10 which constitutes the insulating body of this spark plug 100 will be described. The insulator 10 shown in FIG. 1 and FIG. 2 is formed by sintering alumina or the like as is commonly known, and has a cylindrical shape with an axial hole 12 that is formed in the direction of the axial line O centered on the axis. A flange 19 with the largest outer diameter is formed on rear side of the middle in the direction of the axial line O, and a base end body section 18 is formed on the base end side of that (upper side in FIG. 1). A leading end side body section 17 with an outer diameter smaller than the base end body section 18 is formed on the leading end side of the flange 19 (lower side in FIG. 1). Furthermore, a leg section 13 the with an outer diameter smaller than the leading end side body section 17 is formed on the leading end side of the leading end side body section 17. The leg section 13 is reduced in diameter as it approaches the leading end side, and when the spark plug 100 is mounted in the engine head 200 of the internal combustion engine 201 (see FIG. 2), it is exposed in a combustion chamber 220. Furthermore, a shoulder part 15 is formed between the leg section 13 and the leading end side body section 17.

Next, the central electrode 20 will be described. The central electrode 20 is formed from Inconel (trade name) 600 or 601, another nickel alloy or the like, and inside it has a metal core 23 made of copper or the like with superior thermal conductivity. The central electrode 20 is held at the leading end side of the axial hole 12 of the insulator 10 such that the axial line thereof is aligned with the axial line O of the spark plug 100. The leading end part 22 of the central electrode 20 protrudes from the leading end surface 14 of the leading end part 11 of the insulator 10, and that protruding part is formed so as to have a diameter that is smaller towards the leading end side. To improve the spark erosion resistance, a noble metal tip 90 is connected to the leading end of this protruding part.

In addition, the central electrode 20 is electrically connected to the metal terminal 40 at the base end through a seal 4 and a ceramic resistor 3 provided inside the axial hole 12. The terminal part 41 on the base side of this metal terminal 40 shown in FIG. 1 is exposed to the outside further than the base end body section 18 of the insulator 10, and this terminal part 41 is connected to a high-voltage cable (not shown in the drawing) through a plug cap (not shown in the drawing) such that a high voltage is applied.

Next, the metal housing 50 will be described. As is shown in FIG. 2, the metal housing 50 is a cylindrical housing for affixing of the spark plug 100 to the engine head 200 of the internal combustion engine 201. The metal housing 50 holds the insulator 10 in its own cylindrical hole 59 so as to surround the periphery of the parts from the leg section 13 to the leading end part of the base end body section 18 in a state where leading end part 11 of the insulator 10 protrudes from its leading end surface 57. The metal housing 50 is formed from a low carbon steel material, and a wide diameter mounting part 52 is formed substantially from the center to the leading end side. To enhance the heat resistance of the metal housing 50, it can be made of stainless steel or Inconel.

Male threads 60 are formed on the outer peripheral surface of the mounting part 52 of the metal housing 50. The threads 60 are screwed into female threads 211 formed in a securing part 212 of a mounting hole 210 in the engine head 200 provided on the upper part of the internal combustion engine 201 shown in FIG. 2, and they secure the metal housing 50 in the mounting hole 210. Moreover, in the present embodiment, the nominal diameter of the outer diameter of the threads 60 on the mounting part 52 of the metal housing 50 is 12 mm (12 mm in the embodiment) or less.

The cylindrical part 55, with a narrower diameter than the mounting part 52 of the metal housing 50, is provided on the leading end side of the mounting part 52 of the metal housing (specifically, a diameter narrower than the grooves of the threads).) When the spark plug 100 is mounted in the mounting hole 210 of the engine head 200, the cylindrical part is disposed inside a narrow diameter part 213 (see FIG. 2) on the combustion chamber 220 side of the securing part 212 of the mounting hole 210. Furthermore, a first tapered part 61, which has a tapered shape where the diameter is reduced toward the leading end side is formed between the cylindrical part 55 and the mounting part 52. This first tapered part 61 is in contact with a first step part 214 formed in a tapered shape between the narrow diameter part 213 of the mounting hole 210 and a securing part 212, and leakage from the airtight combustion chamber 220 through the mounting hole 210 is prevented.

In addition, a flange 54 with a larger diameter than the mounting part 52 is formed in a collar shape on the base end side of the mounting part 52 of the metal housing 50. A second tapered part 62 with a tapered shape where the diameter is reduced toward the leading end side is formed between the flange 54 and the mounting part 52. This second tapered part 62 is in contact with a second step part 216 formed in a tapered shape between the securing part 212 of the mounting hole 210 and a large diameter part 215 with a large diameter connected to the opening side of the mounting hole 210 more to the base end side with respect to the securing part 212. The second tapered part 62 prevents leakage of the airtight combustion chamber 220 out of the mounting hole 210 along with the first tapered part 61. In the present embodiment, both of the first tapered part 61 and the second tapered part 62 are given a sealing function that prevents leakage in the airtightness, but it is sufficient to provide a sealing function in at least the second tapered part 62. It is not absolutely necessary to have a sealing function in the first tapered part 61.

As is shown in FIG. 1 and FIG. 2, a wrenching part 51 that is mated with a spark plug wrench not shown in the drawing is formed on the base end side of the flange 54 on the metal housing 50. A crimped part 53 is provided on the base end side of the wrenching part 51, and a thin buckling part 58 is provided between the wrenching part 51 and the mounting part 52. Furthermore, ring-shaped ring members 6, 7 are disposed between inner peripheral surface of the cylindrical hole 59 from the wrenching part 51 to the crimped part 53 and the outer peripheral surface of the base end body section 18 of the insulator 10, and furthermore, talcum (talc) powder 9 is filled in between the two ring members 6, 7. In addition, an internally protruding part 64 protruding inward across the entire circumference of part of the inner peripheral surface such that there is a stepped part 56 that has a surface oriented inward and oriented toward the base end on the inner peripheral surface of the cylindrical hole 59 where the mounting part 52 is formed. When the insulator 10 is held in a cylindrical hole 59, a shoulder part 15 of the insulator 10 is supported through ring-shaped flat packing 8 on the stepped part 56 of this internally protruding part 64.

Furthermore, the end part of crimped part 53 is bent/crimped inward and pressure is applied to the flange 19 of the insulator 10 in the cylindrical hole 59 toward the leading end side through the ring members 6, 7 and talc 9 by tightening. During this tightening, the compression stroke for the crimped part 53 during fabrication is increased by making the buckling part 58 swell toward the outside with the application of compressive force. By this means, the insulator 10 is securely sandwiched and held between the crimped part 53 in the cylindrical hole 59 and the stepped part 56 of the internally protruding part 64, and the metal housing 50 and the insulator 10 form a unit. Airtightness is maintained between the metal housing 50 and the insulator 10 by the flat packing 8, and outflow of combustion gases through the cylindrical hole 59 is prevented.

The grounding electrode 30 will be described next. The grounding electrode 30 is rod shaped, and it is an electrode that is formed in a substantially rectangular shape in the lateral cross-sectional view of the lengthwise direction. Its base end part 32 is connected by being welded to the leading end surface 57 (namely, the leading end surface 57 of the cylindrical part 55) of the metal housing 50. In addition, the leading end part 31 of the grounding electrode 30 is bent so that the inner surface 33 side faces the leading end part 22 of the central electrode 20. A spark discharge gap is formed between that inner surface 33 and the noble metal tip 90 joined to the leading end part 22 of the central electrode 20.

In addition, the grounding electrode 30 made of a Ni alloy with a high oxidation resistance, and as an example, Inconel (trade name) 601 is used. More specifically, the grounding electrode 30 is an alloy that has Ni as the main component, 20 to 30% by weight Cr, 1 to 3% by weight Al, 7 to 20% by weight Fe, 0.1 to 0.5% by weight Mn and 0.1 to 0.5% by weight Si. Therefore, the oxidation resistance of the grounding electrode 30 is increased, and the durability when it is used in atmospheres with higher temperatures is increased. Furthermore, a core 35 made of copper is sealed inside the grounding electrode 30 to increase the thermal conductivity and an increase the heat resistance in a high temperature atmosphere.

Thus, while threads are formed on the mounting part 52 of the metal housing 50 in the spark plug 100 of the present embodiment, there is a cylindrical part 55 where threads are not formed on the leading end side of that mounting part 52.

By this means, the cylindrical part 55 does not come into close contact with the narrow diameter part 213 of the mounting hole 210 when the spark plug 100 is mounted in the mounting hole 210 of the engine head 200 of the internal combustion engine 201. That is, a part that does not come into close contact with the principal metal part 50 in the narrow diameter part 213 near the inside of the combustion chamber 220 within the mounting hole 210 is assured by providing the cylindrical part 55 on the metal housing 50. Therefore, the effects of the thermal stress that can occur in the mounting hole 210 when the mounting hole 210 and the metal housing 50 are in close contact at the narrow diameter part 213 are mitigated. If the narrow diameter part 213 is close to the inside of the combustion chamber 220 and the thermal stress that can occur in the narrow diameter part 213 because of close contact with the metal housing 50 can be mitigated when a heat load is applied with the combustion of the air-fuel mixture in the combustion chamber 220, and the life of the engine head 200 can be increased.

Figure 3:
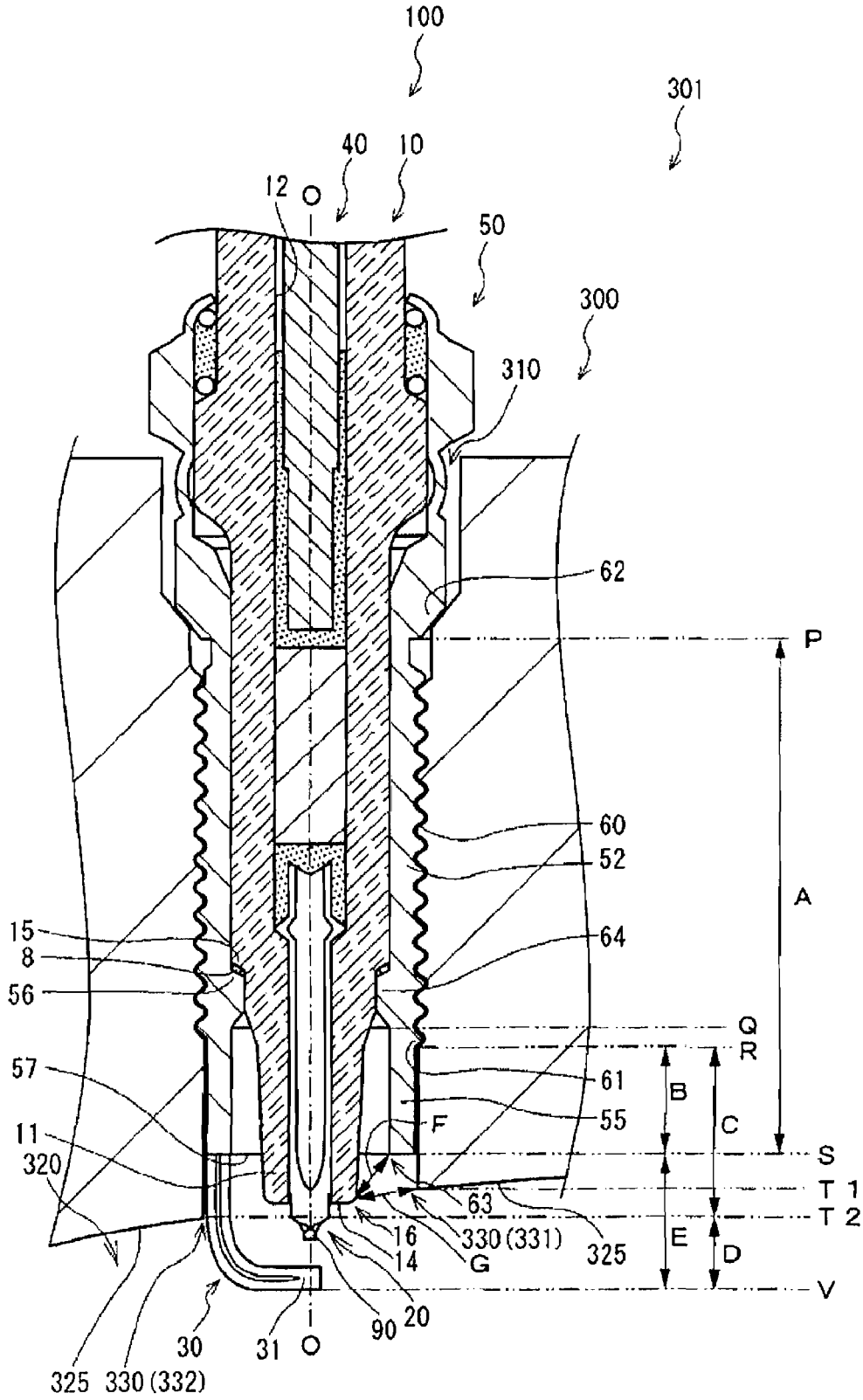
FIG. 3 is a cross-sectional view showing the assembled state of the spark plug in the engine head of an internal combustion engine where the wall surface inside the combustion chamber in the vicinity of the mounting hole is different from FIG. 2.

On the other hand, while part of the heat taken up by the grounding electrode 30 and the cylindrical part 55 of the metal housing 50 with the combustion of the air-fuel mixture in the combustion chamber 220 is conducted to the narrow diameter part 213 from the cylindrical part 55 and conducted to the engine head 200 side, most of it is conducted to the mounting part 52. Furthermore, the heat is conducted out of the grounding electrode 30 and the metal housing 50 by conduction to the securing part 212 of the engine head 200 through the first tapered part 61 and the screw threads 60. In other words, the heat conduction from the metal housing 50 to the engine head 200 mainly occurs in a location away from the combustion chamber 220. Therefore, since it is comparatively easy for heat to accumulate because the heat is not rapidly conducted by the grounding electrode 30 and cylindrical part 55, the spark plug 100 of the present embodiment has a mounting structure that will be explained in the following, and the amount of heat taken up by the cylindrical part 55 with combustion of the air-fuel mixture in the combustion chamber 220 is reduced, and the accumulation of heat can be controlled. Furthermore, increases in the temperature of the grounding electrode 30 and the metal housing 50 are controlled by having the heat in the grounding electrode 30 removed well through the cylindrical part 55, and in addition, the heat resistance of the spark plug 100 is increased. In the following, the mounting structure for the spark plug 100 in the engine head 200 will be described with reference to FIG. 2 and FIG. 3. FIG. 3 is a cross-sectional view showing an assembled state of the spark plug 100 in an engine head 300 of an internal combustion engine 301 where the wall surface 325 inside the combustion chamber in the vicinity of a mounting hole 310 is different from FIG. 2.

First of all, with the spark plug 100 of the present embodiment, the relationship between the length of the mounting part 52 in the direction of the axial line O and the length of the cylindrical part 55 is prescribed. As is shown in FIG. 2, A is the length from the position P of the leading end of the second tapered part 62 of the metal housing 50 in the direction of the axial line O and the position S of the leading end surface 57 (namely, the leading end surface 57 of the cylindrical part 55). Likewise, B is the length from the position R of the leading end of the first tapered part 61 to the position S of the leading end surface 57 (that is, the length of the cylindrical part 55). Based on the results of Working Example 1, which will be described later, the ratio (B/A) of the length of the cylindrical part 55 (length B from R to S) to the total length of the mounting part 52 and the cylindrical part 55 (length A from P to S) at this time is set at 0.2 or greater, and the length B of the cylindrical part 55 at 2 mm or greater.

If B/A is small, the length of the cylindrical part 55 is short compared to the total length of the mounting part 52 and the cylindrical part 55. In other words, the constitution is such that the threads 60 are formed close to the leading end side of the metal housing 50. With the mounting hole 210 of the engine head 200 for the internal combustion engine 201 in which the spark plug 100 is mounted using the metal housing 50 in this manner, it means that the part in close contact with the metal housing 50 through the threads 60 is formed closer to the combustion chamber 220. Therefore, the thermal stress applied to the mounting hole 210 increases, and there is a danger that the life (lifecycle) of the engine head 200 will be shortened. With the spark plug 100 of the present embodiment, B/A is made 0.2 or greater, and the length B of the cylindrical part 55 is made 2 mm or greater, so a part that is not in close contact with the mounting hole 210 can be provided. By this means, the thermal stress applied to the mounting hole 210 can be relaxed, and the life of the engine head 200 can be increased.

Next, the mounting structure is such that when the spark plug 100 of the present embodiment is mounted in the engine head 200, the leading end surface 57 of the cylindrical part 55 is positioned on the inside side of the mounting hole 210 from the wall surface 225 inside the combustion chamber 220 (set so as to be recessed from the combustion chamber 220). Specifically, in the state where the spark plug 100 is mounted in the engine head 200, C is the length between the position R of the leading end of the first tapered part 61 in the direction of the axial line O and the position T of the opening end 230 on the combustion chamber 220 side of the mounting hole 210. Based on the results of Working Example 2 which will be described later, the amount (C−B) the leading end surface 57 of the cylindrical part 55 is recessed from the wall surface 225 inside the combustion chamber is set at 1.5 mm or greater.

The closer the leading end surface 57 of the cylindrical part 55 is to the inner part of the combustion chamber 220, the greater the heat taken up by the metal housing 50 with the combustion of the air-fuel mixture in the combustion chamber 220. To conduct the increased amount of heat, it is good for the parts of the metal housing 50 and the mounting hole 210 that are in close contact to be closer to the combustion chamber 220 so that the heat can be allowed to escape to the engine head 200 side immediately after being taken up. Conversely, to mitigate the thermal stress applied to the mounting hole 210, it is preferable for the metal housing 50 and mounting hole 210 not to be in close contact near to the combustion chamber 220. Therefore, B/A is set to 0.2 or greater as described above and the cylindrical part 55 extended in the direction of the axial line O, and even though a part that is not in close contact with the metal housing 50 is provided in the mounting hole 210 close to the combustion chamber 220, C−B is set at 1.5 mm or greater in the present embodiment so that the amount of heat taken up by the cylindrical part 55 is reduced and the heat is sufficiently removed from the metal housing 50. In other words, the position S of the leading end surface 57 of the cylindrical part 55 is disposed further inside the mounting hole 210 based on a position T of the opening end 230. Therefore, the cylindrical part 55 is kept away from the inside of the combustion chamber 220 and is such that it is difficult for the cylindrical part 55 to take up heat. By controlling the increase in temperature of the cylindrical part 55 by the heat accompanying combustion of the air-fuel mixture in this manner, it is possible to conduct heat from the grounding electrode 30, which is connected to the leading end surface 57, efficiently, and increase the heat resistance of the spark plug 100.

Moreover, in the description above, an example where the mounting hole 210 is opened along the direction orthogonal to the wall surface 225 of the combustion chamber in the combustion chamber 220 (that is, as is shown in FIG. 2, in the state where the spark plug 100 is mounted in the mounting hole 210, the outline of the wall surface 225 in that combustion chamber is perpendicular to the axial line O when the wall surface 225 inside the combustion chamber is viewed in any cross-section that includes the axial line O of the spark plug 100) is examined. Naturally, there are also cases where, as in the engine head 300 of the internal combustion engine 301 shown in FIG. 3, the mounting hole 310 does not open along a direction orthogonal to the direction of the plane of the wall surface 325 inside the combustion chamber for the combustion chamber 320. For example, there are cases where the virtual circle drawn, for example, by the opening end 330 of the mounting hole 310 opening in the wall surface 325 inside the combustion chamber is not in a single plane orthogonal to the axial line O of the spark plug 100. When the wall surface 325 inside the combustion chamber is viewed in any cross-section that includes the axial line O of the spark plug 100 in an embodiment like this, the opening end 330 of the mounting hole 310 in the direction of the axial line O differs on the left side and the right side of the axial line O in that cross-sectional view. Specifically, in the example in FIG. 3, the position T1 of the opening end 331 on the right side of the axial line O in the drawing and the position T2 of the opening end 332 on the right side of the axial line O of the opening end 330 of the mounting hole 310 are disposed differently in the direction of the axial line O. Even in this case, if the position at the leading end surface 57 of the cylindrical part 55 of the metal housing 50 originally back inside the mounting hole 310 from the opening end 330 of the mounting hole 310 is disposed at least 1.5 mm from the opening end 330 in the direction of the axial line O, the heat taken up by the cylindrical part 55 can be controlled. To put it another way, it is sufficient to make the length C−B for the position S of the leading end surface 57 of the cylindrical part 55 of the metal housing 50 and the position (position T2 in this case) of the opening end (opening end 332 in this case) that is furthest from the leading end surface 57 in the direction of the axial line O on the opening end 330 of the mounting hole 310 be 1.5 mm or more.

In addition, while in the example in FIG. 3, the positional relationship between the position T2 for the opening end 333 on the left side of the axial line O in the figure on the opening end 330, for example, and the position S of the leading end surface 57 of the cylindrical part 55 is unaltered, there are cases of mounting structures where the position T1 for the opening end 331 on the right side of the axial line O in the figure is positioned on the base end side in the direction of the axial line O from the position S of the leading end surface 57 of the metal housing 50 according to the position in which the mounting hole 310 is opened in the wall surface 325 of the combustion chamber. In other words, there are cases of mounting structures where part of the leading end surface 57 of the cylindrical part 55 is disposed more to the inside the mounting hole 310 with respect to the opening of the mounting hole 310 on the side of the combustion chamber 320, and the remaining part of the leading end surface 57 is disposed more to the inside of the combustion chamber 320 with respect to the opening end 330. Even in such cases, if the length C−B in the direction of the axial line O for the position T2 of the opening end 332 and the position S of the leading end surface 57 of the cylindrical part 55 satisfies the positional relationship of 1.5 mm or greater, the heat that is conducted by the cylindrical part 55 can be controlled sufficiently.

Moreover, when the opening end 230 of the mounting hole 210 is chamfered, the chamfered surface thereof is viewed as the inner peripheral surface of the mounting hole 210, and the aligned parts of the wall surface 225 inside the combustion chamber and the chamfered surface are set as the opening and 230. Position T of the opening end 230 in the direction of the axial line O can be determined.

Next, the amount the grounding electrode 30 protrudes (length) on the leading end side in the direction of the axial line O inside the combustion chamber 220 shown in FIG. 2 is set in the spark plug 100 of the present embodiment. Specifically, when the spark plug 100 is mounted in the engine head 200 of the internal combustion engine 201, D is the length from the position T of the opening end 230 on the combustion chamber 220 side of the mounting hole 210 to the part (position V) positioned furthest on the leading end side of the parts of the grounding electrode 30. At this time, the amount (D) of the grounding electrode 30 protruding into the combustion chamber 220 is prescribed to be 3 mm or more.

The spark discharge gap formed between the noble metal tip 90 provided on the leading end part 22 of the central electrode 20 and the grounding electrode 30 inside the combustion chamber 220 is naturally more toward the base end side in the direction of the axial line O with respect to a portion closest toward the leading end side of the grounding electrode 30, in consideration of the thickness of the grounding electrode 30. When the amount of protrusion (D) of the grounding electrode 30 inside the combustion chamber 220 is less than 3 mm in the design of the spark plug 100, the amount the spark discharge gap protrudes into the combustion chamber 220 is a maximum of approximately 1 mm when the thickness of the grounding electrode 30 is subtracted. In other words, the amount the spark discharge gap protrudes into the inside of the combustion chamber 220 from the wall surface 225 of the combustion chamber becomes smaller, so there is a danger of a reduction in the ignition performance.

Moreover, in the same manner as described above, the case where the mounting hole 310 in the engine head 300 for the internal combustion engine 301 shown in FIG. 3 does not open along a direction orthogonal to the direction of the plane for the wall surface 325 in the combustion chamber is as follows: Namely, it is sufficient for the length D for the position T2 for the opening end 332, which is furthest toward the leading end of the positions T1 and T2 of the opening end 330 in the direction of the axial line O, and the position V for the part of the grounding electrode 30 furthest to the leading end side to be 3 mm. To put it another way, it is sufficient for the minimum length for position V and the position (position T2 in this case) of the opening end (opening end 332 in this case) most toward the leading end in the direction of the axial line O of the opening end 330 of the mounting hole 310 to be 3 mm or more.

Furthermore, with the spark plug 100 of the present embodiment, the amount of protrusion (length) of the grounding electrode 30 to the leading end side in the direction of the axial line O from the leading end surface 57 of the cylindrical part 55 as shown in FIG. 2 is also set. Specifically, E is the length (length of protrusion of the grounding electrode 30) from the position S of the leading end surface 57 of the cylindrical part 55 of the metal housing 50 to the part (position V) position for this to the leading end side of the parts of the grounding electrode 30. At this time, the length of the protrusion (E) from the leading end surface 57 of the grounding electrode 30 is set at 9 mm or less. If the protrusion length E is increased, the length of the grounding electrode 30 is extended, and the path for the heat to escape to the cylindrical part 55 side of the grounding electrode 30 becomes longer, so it invites increases in the temperature of the grounding electrode 30. When the protrusion length E is larger than 9 mm and B/A described above is 0.2 or greater, there is a danger of exceeding the temperature limits for the heat resistance of the grounding electrode 30 (temperature limits for oxidation of the material of the grounding electrode 30) according to the results of Working Example 4, which will be described later.

By the way, the cylindrical part 55 constitutes the pathway for the heat of the grounding electrode 30 to escape to the engine head 200 through the mounting part 52. If B/A is increased as described above, the mounting part 52 can be disposed deeper in the mounting hole 210, but along with this, the length of the pathway for heat conduction from the grounding electrode 30 becomes longer. According to the results of Working Example 4, it can be seen that the efficiency for heat conduction from the grounding electrode 30 decreases as the value for B/A increases, and the temperature of the grounding electrode 30 rises. On the other hand, the larger the protrusion length (E) of the grounding electrode 30 and the more it protrudes into the combustion chamber 220, the better it is for assuring ignition performance, but according to Working Example 4 which will be described later, it can be seen that variations in the size of the grounding electrode 30 invite increases in its temperature.

In other words, if improvements are made in the efficiency of conducting heat from the grounding electrode 30, it is possible to mitigate the effects of making increases in the temperature of the grounding electrode. Specifically, if a material that has higher thermal conductivity is used for the grounding electrode 30 and the grounding electrode 30 is given a double layer structure having a high thermal conductivity core, B/A can be increased more and the mounting part 52 disposed deeper inside the mounting hole 210 while increasing the protrusion length E and increasing the ignition performance.

In addition, when F is the minimum distance for the outer peripheral edge 16 on the leading end surface 14 of the insulator 10 and the inner peripheral edge 63 of the leading end surface 57 of the metal housing 50 and G is the minimum distance for the outer peripheral age 16 on the leading end surface 14 of the insulator 10 and the opening end 230 of the mounting hole 210 in the present embodiment, F>G is to be satisfied. If F>G is satisfied, the straight-line distance is shorter for the outer peripheral edge 16 of the leading end surface 14 of the insulator 10 and the opening end 230 of the mounting hole 210 than the inner peripheral edge 63 of the leading end surface 57 of the metal housing 50 (that is, the inner peripheral edge 63 of the cylindrical part 55). Therefore, the spark discharge that occurs when there is carbon fouling arises more easily between the peripheral lead 16 of the leading end surface 14 of the insulator 10 and the opening end 230 of the mounting hole 210 in between the outer peripheral lead 16 of the leading end surface 14 of the insulator 10 and the inner peripheral edge 63 of the cylindrical part 55. In other words, the spark discharge occurring at that time can be made closer to the inside of the combustion chamber 220, so it can be easier for the air-fuel mixture to ignite. Thus, ignition performance for the air-fuel mixture can be assured when carbon fouling arises on the spark plug 100.

Furthermore, in the present embodiment, the position Q of the leading end of the internally protruding part 64 provided for holding the insulator 10 in the cylindrical hole 59 of the metal housing 50 is set more to the base end side in the direction of the axial line O with respect to the position R of the leading end of the first tapered part 61 of the metal housing 50. The heat (called "heat originating in the central electrode" hereinafter) that accompanies the combustion of the air-fuel mixture in the combustion chamber 220 that is taken up by the central electrode 20 is conducted to the insulator 10 and flows from the shoulder part 15 to the internally protruding part 64 of the metal housing 50 through the flat packing 8. The path for conducting the heat to the engine head 200 passes through first tapered part 61 and the threads 60 of the mounting part 52. On the other hand, while part of the heat (called "heat originating in the cylindrical part" hereinafter) taken up by the cylindrical part 55 of the metal housing 50 is conducted from the cylindrical part 55 to the narrow diameter part 213 and conducted to the engine head 200 side, most is conducted to the mounting part 52 and the pathway for conducting it to the engine head 200 side goes through the first tapered part 61 and the threads 60 of the mounting part 52. Here, if the position Q of the leading end of the internally protruding part 64 of the metal housing 50 is toward the leading end side of the position R of the leading end of the first tapered part 61, there is a confluence with the heat originating in the cylindrical part when the heat originating in the central electrode is conducted to the engine head 200. Therefore the amount of the heat accumulated is comparatively high in the vicinity of the internally protruding part 64, and it is not conducted rapidly. As a result, there is a danger that the heat will not be conducted out of cylindrical part 55 rapidly.

To sufficiently mitigate the effects of the thermal stress applied to the mounting hole 210 as well as find the various conditions for good withdrawal of the heat from the spark plug 100 itself in designing the spark plug 100 as described above, the following evaluation tests were carried out.

Working Example 1

First of all, the effects on the life (lifecycle) of the engine head 200 by the thermal stress that can occur between the mounting hole 210 of the engine head 200 and the metal housing 50 of the spark plug 100 were evaluated. In this evaluation test, a plurality of spark plug samples where the ratio of length of the cylindrical part 55 to the total length of the mounting part 52 and the cylindrical part 55 (B/A) differed were fabricated and each of them mounted in an evaluation engine. Furthermore, the engine was driven according to a prescribed test pattern, and the lifecycle was found from the travel distance envisioned for each sample when problems arose in the engine head because of the thermal stress arising in the parts of close contact between the metal housing and the mounting hole. The results of this evaluation test are shown in the graph in FIG. 4.

Figure 4:
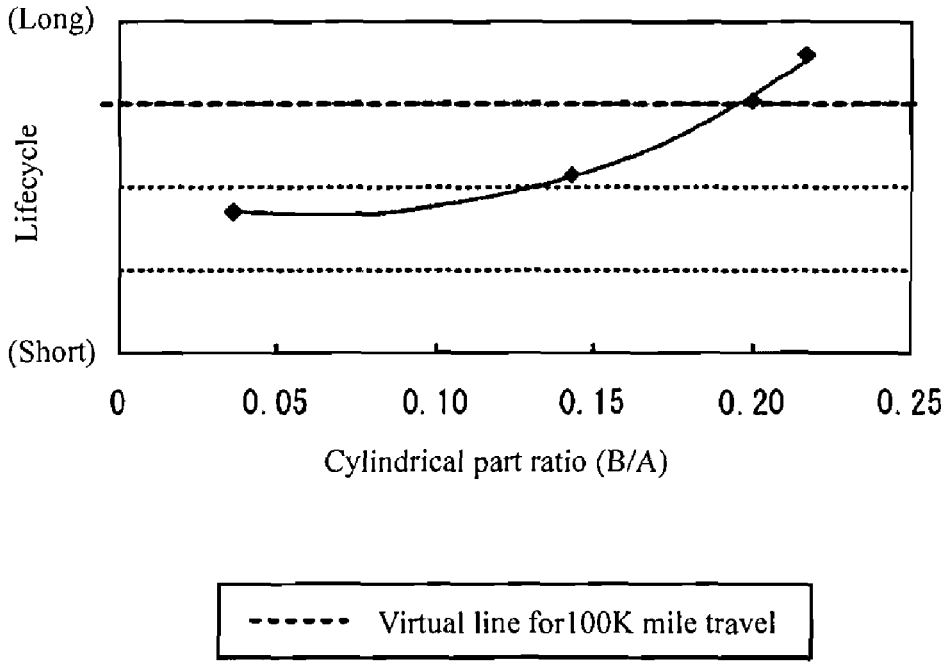
FIG. 4 is a graph showing the relationship between the ratio (B/A) of the length of the cylindrical part to the total length of the mounting part and the cylindrical part and the life (life-cycle) of the engine head.

As is shown in FIG. 4, it was found that the lifecycle increases as the value for B/A increases. Furthermore, when B/A is 0.2 or greater, the envisioned travel distance was a lifecycle equivalent to running 100,000 miles. The shorter of the length of the cylindrical part 55 to the total length of the mounting part 52 and the cylindrical part 55 is the closer the location where the threads 60 are formed is to the vicinity of the opening on the combustion chamber 220 side of the mounting hole 210 in the engine head 200. A thermal load is applied in the vicinity of the opening on the combustion chamber 220 side of the mounting hole 210 with the combustion of the air-fuel mixture inside the combustion chamber 220, but in addition to this, there is thermal stress applied from the side of the spark plug 100 because of the threads being screwed in. Therefore, the smaller the value is for B/A, the greater the thermal stress applied to the mounting hole 210 becomes, and it was found that the life of the engine head 200 is affected.

Working Example 2

Next, the extent the leading end surface 57 of the cylindrical part 55 is recessed in the mounting hole 210 from the wall surface 225 inside the combustion chamber for improving the heat conduction performance of the metal housing 50 was evaluated. In this evaluation test, a plurality of engine head samples where the starting location for the female threads in the mounting hole on the combustion chamber side differed were prepared, and on the other hand, spark plug samples were fabricated with grounding electrodes with embedded temperature probes in the metal housing and a length ratio of 0.2 for the cylindrical part to the total length of the mounting part and the cylindrical parts for the evaluation. Furthermore, an engine was assembled using the various engine head samples, the evaluation spark plugs mounted and run. The temperature of the grounding electrodes was measured at that time. The results of this evaluation test are shown in the graph in FIG. 5.

Figure 5:
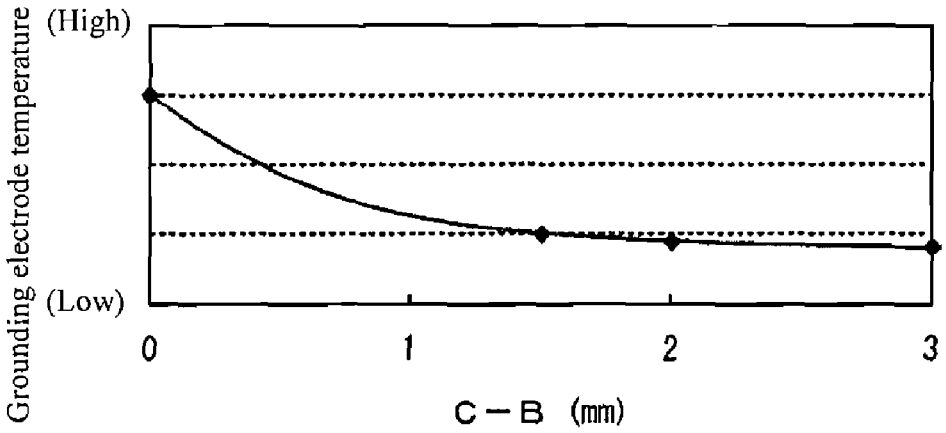
FIG. 5 is a graph showing the relationship between the recessed amount (C−B) for the grounding electrode and the temperature of the grounding electrode.

As is shown in FIG. 5, the grounding electrode temperature increased as the amount of recess from the wall surface inside the combustion chamber for the leading end surface of the cylindrical part decreased. In other words, it can be seen that the amount of heat taken up by the cylindrical part itself as the leading end surface of the cylindrical part approaches the combustion chamber increased, so heat was no longer sufficiently conducted out of the grounding electrode. On the other hand, if C−B increased, the temperature of the grounding electrode decreased, but when C−B is 1.5 mm or greater, the temperature of the grounding electrode was in a substantially constant state. In other words, if C−B is 1.5 mm or greater, heat in the grounding electrode was shown to be sufficiently conducted, including the heat taken up by the cylindrical part.

Working Example 3

Next, the relationship between the amount of protrusion (D) of the grounding electrode 30 inside the combustion chamber 220 and ignition performance was evaluated. In this evaluation test, a plurality of spark plug samples where the length in the direction of the axial line O from the wall surface inside the combustion chamber to the location closest to the leading end side of the grounding electrode in a range of 2 mm to 7 mm in a state where the spark plugs were mounted in the engine head were fabricated. Furthermore, each of the samples was installed in an evaluation engine (6 cylinder, 2.0 L displacement). A air-fuel mixture with an air to fuel ratio of 14.5 was supplied, the engine was run at 750 rpm, and the firing pressure was measured. The indicated mean effective pressure (IMEP) was calculated by a commonly known method for a single sample from the firing pressures obtained for each cycle. The average value and standard deviation were found from the calculated results for 500 cycles, and the degree of fluctuation of combustion P1(%) shown in the following equation was found. Combustion fluctuation Pi= (standard deviation/average value)×100(%) Moreover, the lower combustion fluctuation Pi, which gives the fluctuation of the indicated mean effective pressure, is, the more stable with the ignition state of the air-fuel mixture is, and it is seen as a state where high ignition performance is maintained. Typically, when it exceeds 20% or more, accidental firing is viewed as occurring. The results of this evaluation test are shown in the graph in FIG. 6.

Figure 6:
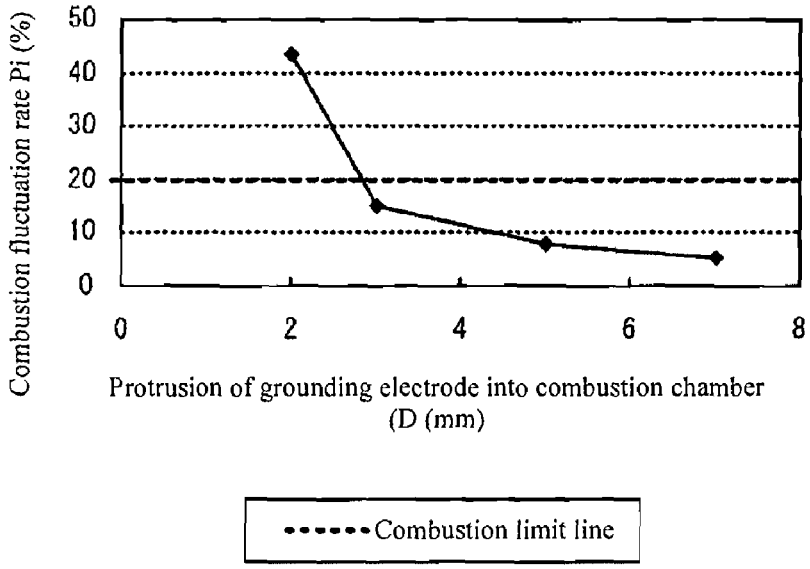
FIG. 6 is a graph showing the relationship between the amount of protrusion (D) of the grounding electrode in the combustion chamber at and the combustion fluctuation.

As is shown in FIG. 6, it was found that the larger the amount of protrusion D of the grounding electrode in the combustion chamber is, the smaller the combustion fluctuation Pi and becomes. Specifically, as the amount of protrusion D increases from 3 mm to 7 mm, the combustion fluctuation Pi gradually decreases under 20%, but if the amount of protrusion is 2 mm the combustion fluctuation Pi suddenly increases in larger than 40%, and exceeds the combustion limit of 20%. From the results of this evaluation test, it was found that if the amount of protrusion D of the grounding electrode into the combustion chamber was 3 mm or greater, sufficient ignition performance was obtained.

Working Example 4

Next, the relationship between the ratio (B/A) of the length of the cylindrical part 55 to the total length of the of the mounting part 52 and the cylindrical part 55 and the critical temperature for oxidation of the grounding electrode 30 was evaluated. In this evaluation test, 3 of each of the plurality of metal housings with different B/A the same as in Working Example 1 were prepared, and spark plug samples where a grounding electrode with a protrusion length E of 5 mm formed from solid Inconel (trade name) 600 and where a grounding electrode with a protrusion length E of 9 mm formed from solid Inconel (trade name) 601 in which a temperature probe was embedded were fabricated. Furthermore, each of the samples was mounted in the engine and run in the same manner as in Working Example 2, and the temperature of the grounding electrode was measured at that time. Moreover, the mounting hole in the engine head was adjusted so that the amount the cylindrical part was recessed for each sample was 1.5 mm. Furthermore, a relative comparison was made of the relationship of the temperature of the grounding electrode for each of the samples and B/A based on the limit temperature for oxidation of the material forming each of the grounding electrode. The results of this evaluation test are shown in the graph in FIG. 7.

Figure 7:
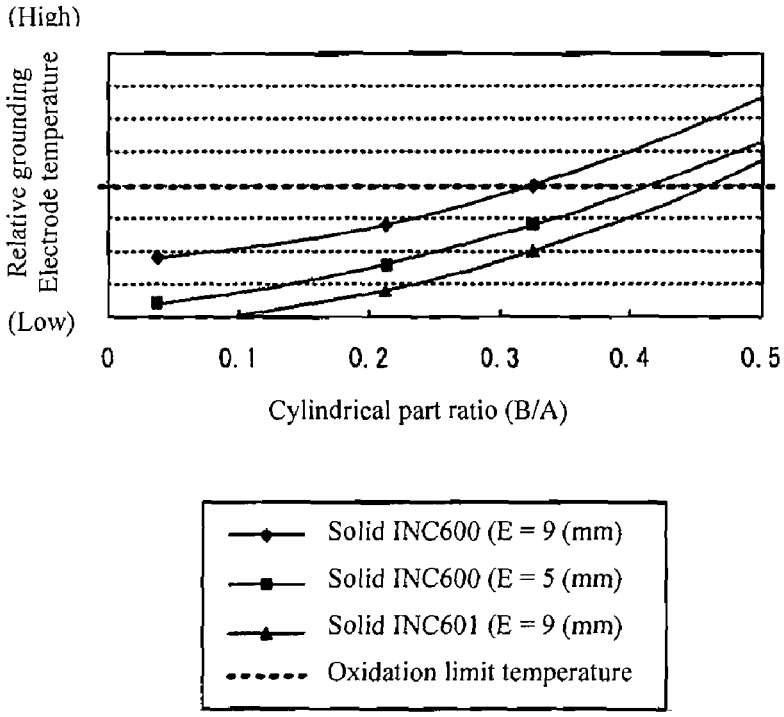
FIG. 7 is a graph showing the relationship between the ratio (B/A) of the length of the cylindrical part to the total length of the mounting part and the cylindrical part, the temperature of the grounding electrode and the length of the protrusion (E) of the grounding electrode.

As is shown in FIG. 7, the temperature of the grounding electrode rose as B/A became larger for all of the samples. The cylindrical part of the metal housing forms the escape path for the heat of the grounding electrode to the engine head through the mounting part, and it can be seen that if B/A becomes large, that path becomes longer, the heat conduction efficiency is reduced and the temperature of the grounding electrode rises. In addition, regardless of the differences in the protrusion length E for the grounding electrode from the leading end surface of the metal housing, the increasing trends in the graphs showing B/A and the temperature of the grounding electrode (slope in the graph) were similar. It can be understood from this that if width of variation in the size of the protrusion length E is constant, the width of the variations in the temperature of the grounding electrode will be substantially constant regardless of B/A.

In addition, when the graph for the E=9 (mm) formed from Inconel 600 and the graph for Inconel 601, which has a higher thermal conductivity than Inconel 600, are compared, temperatures of the grounding electrode in the graph for the Inconel 600 were shifted to the higher side. It was found that the grounding electrode formed from this Inconel 600 had stricter temperature conditions. Furthermore, when the graph for the grounded in electrode with E=9 (mm) formed from Inconel 600 was compared with the graph for the grounding electrode with E=5 (mm), it was found that the temperature conditions were stricter as the protrusion length E became longer. In other words, the effects of variations in the size of the grounding electrode on the temperature of the grounding electrode itself can be understood. From this, it can be understood that if the protrusion length E is extended and the path for the heat to escape to the cylindrical part side of the grounding electrode becomes longer, it invites increases in the temperature of the grounding electrode.

Specifically, furthermore, with the grounding electrode with E=9 (mm) formed from Inconel 600, which had the strictest temperature conditions of the various samples, the temperature of the grounding electrode, which rises when B/A becomes larger, reached the limit temperature for oxidation when B/A exceeded 0.3. In Working Example 1 it was demonstrated that it was sufficient for B/A to be 0.2 or more, but with examinations including the results of this evaluation test, it was found that a grounding electrode design with more margin in terms of the temperature conditions was possible by setting the material for the grounding electrode and the length of the protrusion E.

Moreover, it goes without saying that there can be various modifications of the present invention. For example, if Inconel (trade name) 601 was used for the grounding electrode 30, but another metal can be used if it is a metal with superior oxidation resistance. In addition, there need not be the core 35 in the grounding electrode 30 if sufficient heat conduction performance can be obtained using the metal housing 50 through the cylindrical part 55.

Figure 8:
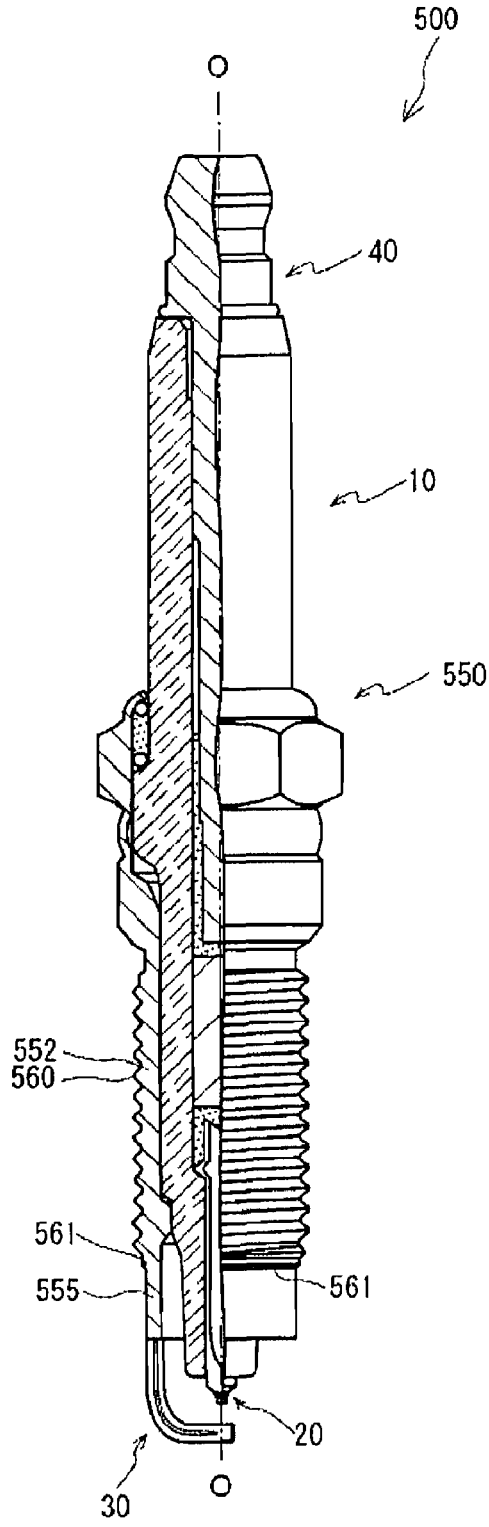
FIG. 8 is a drawing for describing the structure of the first tapered part of the spark plug as an example of a modification.

Moreover, in the present embodiment, a form where the first tapered part 61 is continuous from both the cylindrical part 55 and the mounting part 52 is formed, but the constitution of the present invention is not limited to this. Giving a detailed description, as, for example, is shown in FIG. 8, a first tapered part 561 as in a spark plug 500 is formed continuously with the cylindrical part 555, while a mounting part 552 on which threads 560 are formed does not necessarily have to be formed continuously, but it can be formed substantially continuously. To conduct the heat, for example, ones where the first tapered part 561 and the mounting part 552 are formed separated by more than 10 mm are precluded, but constitutions that are formed in closer proximity than that or as in the embodiment shown in FIG. 2 with part of the first tapered part 61 overlapping the leading end area of the mounting part 52 are easily permissible.

A constitution where the threads 60 closest to the leading end side of the threads 60 on the mounting part 52 overlap the first tapered part 61 is permissible.

The invention claimed is:

1. A spark plug comprising:

a central electrode, an insulator having an axial hole extending in the direction of an axial line and holding the central electrode at the leading end side of the axial hole, a metal housing including:

a cylindrical hole extending in the direction of the axial line and holding at least part of the insulator in the cylindrical hole;

a mounting part having screw threads to be screwed into a mounting hole of an internal combustion engine on an outer peripheral surface of the mounting part, the screw threads having a nominal diameter of 12 mm or less;

a cylindrical part provided on a leading end side of the mounting part, the cylindrical part having a diameter smaller than a diameter of the mounting part and having a leading end surface which is to be disposed inside the mounting hole;

a first tapered part connecting an outer peripheral surface between the cylindrical part and the mounting part in the vicinity of the leading end of the mounting part in a tapered shape;

a flange part provided on the base end side of the mounting part, the flange part having a diameter larger than a diameter of the mounting part; and a second tapered part connecting an outer peripheral surface between the mounting part and the flange part in a tapered shape, wherein the ratio B/A is 0.2 or greater;

B is 2 mm or greater, and

C−B is 1.5 mm or greater when A is an axial length from a leading end of the second tapered part to the leading end surface of the cylindrical part, B is an axial length from the leading end of the first tapered part to the leading end surface of the cylindrical part, and C is the maximum axial length from the leading end of the first tapered part to an opening end on the combustion chamber side of the mounting hole when the metal housing is screwed into the mounting hole of the internal combustion engine.

2. The spark plug according to claim 1 further comprising a grounding electrode having one end connected to the leading end surface of the cylindrical part of the metal housing, and the other end forming a spark discharge gap with a leading end of the central electrode, wherein D is 3 mm or greater when D is the minimum axial length from the opening end on the combustion chamber side of the mounting hole to the leading end side of the part of the grounding electrode when the metal housing is screwed into the mounting hole of the internal combustion engine.

3. The spark plug according to claim 2 wherein E is 9 mm or greater when E is an axial length from the leading end surface of the cylindrical part of the metal housing to the axial leading end of the grounding electrode.

4. The spark plug according to claim 1 further comprising a grounding electrode having one end connected to the leading end surface of the cylindrical part of the metal housing and the other end forming a spark discharge gap with the leading end of the central electrode, wherein E is 9 mm or less when E is an axial length from the leading end surface of the cylindrical part of the metal housing and the axial leading end of the grounding electrode.

5. The spark plug according to claim 1 wherein F>G is satisfied when F is the minimum distance for the edge of the outer peripheral edge on the leading end surface of the insulator and the inner peripheral edge of the leading end surface of the metal housing and G is the minimum distance for the outer peripheral edge on the leading end surface of the insulator and the opening end on the combustion chamber side of the mounting hole.

6. The spark plug according to claim 1 wherein the metal housing further comprising an internally protruding part that protrudes from the inside peripheral surface of the cylindrical hole of the metal housing toward the inside, extending across the entire periphery, the insulator engaged with a base end side of the internally protruding part in the direction of the axial line, a leading end of the internally protruding part being positioned on the base end side with respect to the first tapered part of the leading end.

7. An internal combustion engine having a mounting hole opening to a combustion chamber and formed with female threads on the inside periphery, in which the spark plug according to claim 1 is mounted.

* * * * *